US007387598B2

(12) United States Patent
Miller

(10) Patent No.: US 7,387,598 B2
(45) Date of Patent: Jun. 17, 2008

(54) MULTIFUNCTIONAL PORTABLE PNEUMATIC EXERCISE DEVICE

(76) Inventor: Curtis J. Miller, 14791 Hillsboro Pl., Tustin, CA (US) 92780

( * ) Notice: Subject to any disclaimer, the term of this patent is extended or adjusted under 35 U.S.C. 154(b) by 35 days.

(21) Appl. No.: 11/603,820

(22) Filed: Nov. 24, 2006

(65) Prior Publication Data

US 2007/0197356 A1 Aug. 23, 2007

Related U.S. Application Data

(60) Provisional application No. 60/775,330, filed on Feb. 22, 2006.

(51) Int. Cl.
*A63B 21/008* (2006.01)

(52) U.S. Cl. ..... 482/112; 482/111; 188/284; 188/285; 188/322.13; 188/322.14

(58) Field of Classification Search ..... 482/62–63, 482/92, 111–113; 118/284–289, 322.13, 118/322.14; 124/65; *A63B 21/008*
See application file for complete search history.

(56) References Cited

U.S. PATENT DOCUMENTS

| | | | | |
|---|---|---|---|---|
| 767,008 | A * | 8/1904 | Pelletier | 482/112 |
| 3,174,343 | A * | 3/1965 | Kasulis | 482/112 |
| 3,944,221 | A * | 3/1976 | Berkestad et al. | 482/112 |
| 4,106,392 | A | 8/1978 | Johnson | |
| 4,832,335 | A | 5/1989 | Tong | |
| 4,880,230 | A | 11/1989 | Cook | |
| 4,951,941 | A | 8/1990 | Resk | |
| 5,215,508 | A | 6/1993 | Bastow | |
| 5,501,646 | A * | 3/1996 | Miller | 482/11 |
| 5,529,559 | A | 6/1996 | Punzalan | |
| 5,803,879 | A | 9/1998 | Huang | |
| 6,158,083 | A | 12/2000 | Holsten | |
| 6,402,667 | B1 | 6/2002 | Dahn | |
| 6,468,190 | B1 | 10/2002 | Fazio | |
| D470,201 | S | 2/2003 | Paull | |
| D500,101 | S | 12/2004 | Fitzgerald | |
| 6,936,085 | B2 | 8/2005 | DeMarco | |
| 2003/0017920 | A1 | 1/2003 | Fazio | |
| 2005/0266970 | A1 | 12/2005 | Tuller | |

FOREIGN PATENT DOCUMENTS

| | | |
|---|---|---|
| JP | 5076620 | 3/1993 |
| WO | WO93/14822 | 8/1993 |

* cited by examiner

*Primary Examiner*—LoAn H. Thanh
*Assistant Examiner*—Ryan Durcik
(74) *Attorney, Agent, or Firm*—Richard C. Litman

(57) ABSTRACT

The multifunctional portable pneumatic exercise device is a muscular exercise and training device that may be used for a multiplicity of exercises and with a wide variety of muscle groups. The exercise device includes a telescopic tube that is sealed at a distal end thereof and has a valve mounted on the proximal end thereof. In operation, the user compresses the telescopic tube and the increased air pressure within the telescopic tube causes fluid resistance, providing the user with muscular exercise. The user controls the fluid resistance through selective adjustment of the valve, which controls the volume of air escaping from the telescopic tube. Further, a pair of straps are releasably secured to either end of the telescopic tube, allowing the telescopic tube to be secured to a selected body part. The exercise device is portable, easy to operate and provides a wide range of muscular exercises for the user.

10 Claims, 3 Drawing Sheets

MULTIFUNCTIONAL PORTABLE PNEUMATIC EXERCISE DEVICE

CROSS-REFERENCE TO RELATED APPLICATION

This application claims the benefit of U.S. Provisional Patent Application Ser. No. 60/775,330, filed Feb. 22, 2006.

BACKGROUND OF THE INVENTION

1. Field of the Invention

The present invention relates to exercise devices, and particularly to a multifunctional portable pneumatic exercise device for exercising a wide variety of muscle groups.

2. Description of the Related Art

A wide variety of resistance-based exercise devices are used for both athletic training and for muscular exercise. Non-weight-based devices are considered preferable for particular types of exercise because they are generally portable and may be applied to a multiplicity of exercises and muscle groups. Such devices often utilize elastic elements or fluid pressure as a form of resistance.

Fluid pressure exercise devices are known in the art and typically include a container for holding the fluid and a plunger, or plungers, to be pushed or pulled through the fluid. Given the stress and strain placed upon the plungers, these systems are susceptible to leakage of the fluid, which renders them practically useless.

Similar systems utilizing telescopic tubes are known in the art, wherein collapse of the telescopic tube provides the resistance required for exercise. Such systems, however, are generally only adapted to one particular body part and are not multifunctional. Further, such systems typically do not provide the user with much control over the fluid pressure, which translates to a lack of control over the resistance. In addition, such systems can be difficult to use, as they tend not to be secured to the user's body while in use. Thus, a multifunctional portable pneumatic exercise device solving the aforementioned problems is desired.

SUMMARY OF THE INVENTION

The multifunctional portable pneumatic exercise device is a muscular exercise and training device that may be used for a multiplicity of exercises and with a wide variety of muscle groups. The exercise device includes a telescopic tube that is sealed by a wall at a distal end thereof and has a valve mounted on the proximal end thereof. The valve housing defines an internal valve chamber therein, with the valve chamber being in communication with the interior of the telescopic tube via a plurality of openings formed through an inner wall of the housing.

A valve is received within the valve chamber, allowing the user selective control over fluid flow within the chamber. The valve is preferably a plunger having a disc with a centrally mounted rod formed thereon. The user vertically positions the disc within the chamber to selectively partially cover the plurality of openings. Particularly, the upper end of the rod may be threaded for engaging an upper wall of the valve chamber. A gripping member is mounted on the upper end of the rod for grasping by the user. By rotating the gripping member, the user may raise or lower the rod and disc within the chamber, allowing the user to selectively control the volume and rate of air passage through the plurality of openings.

In operation, the user compresses the telescopic tube and the increased air pressure within the telescopic tube causes fluid resistance, as the air escapes through the valve housing, providing the user with muscular exercise. Similarly, the user receives muscular exercising during the process of expanding the telescoping tube following collapse. In the collapsed state, a minimal amount of air remains within the telescopic tube. Thus, expansion of the tube requires force generated by the user, which is translated into suction of air through the plurality of openings in the valve chamber and into the telescopic tube. This applied force to return air within the telescopic tube allows the user to exercise a different set of muscles than are required to compress the telescopic tube. The user controls the fluid resistance through selective adjustment of the valve, which controls the volume of air escaping from the telescopic tube.

Further, a pair of straps are releasably secured to either end of the telescopic tube, allowing the telescopic tube to be secured to a selected body part. Each strap engages a respective engaging member, one being mounted on the exterior surface of the distal wall, and one being mounted on the exterior surface of an outer wall of the valve housing.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
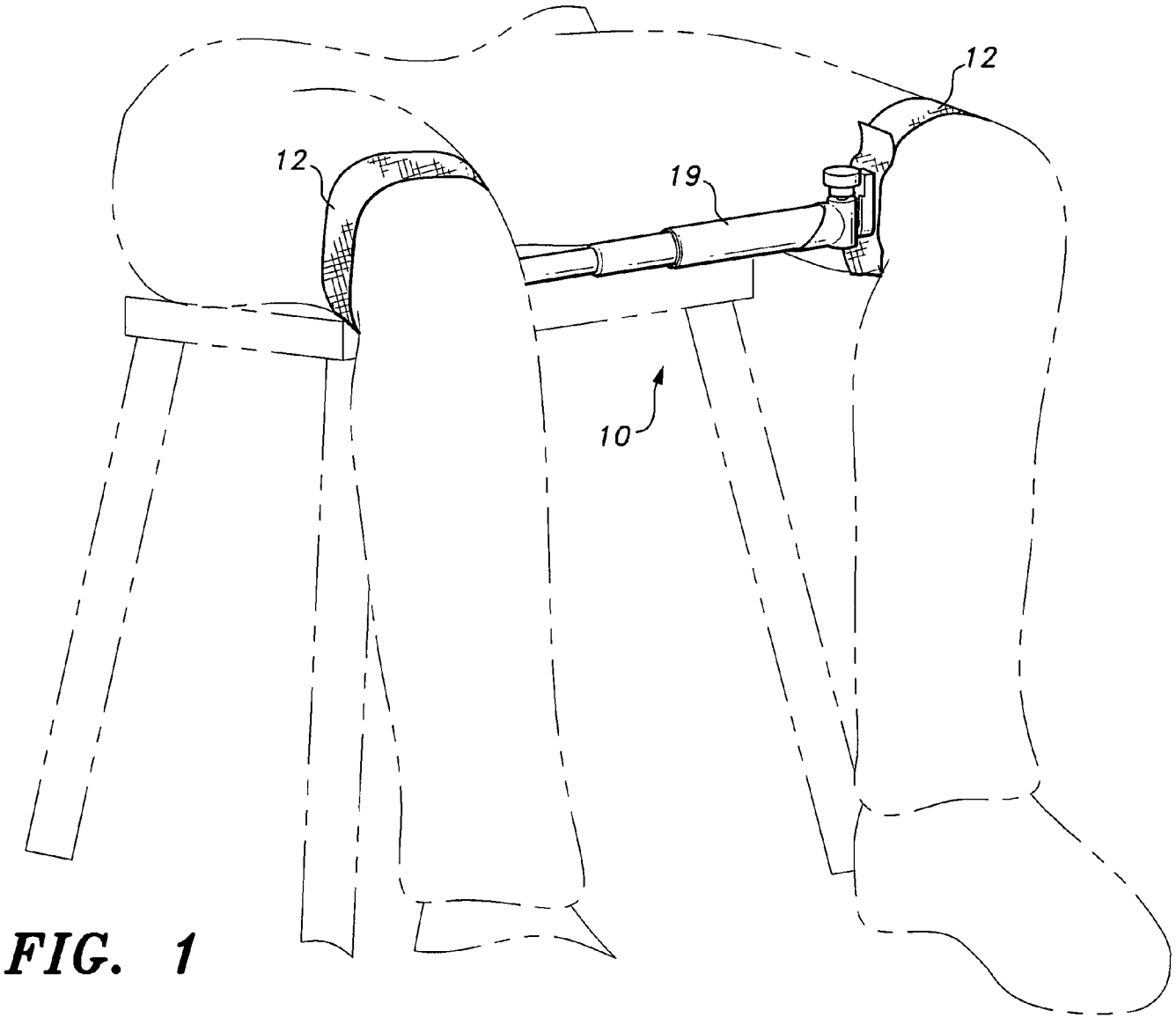
FIG. 1 is an environmental, perspective view of a multifunctional portable pneumatic exercise device according to the present invention.

Referring now to FIG. 1, there is shown a multifunctional portable pneumatic exercise device 10 being used to exercise a user's thighs. The exercise device 10 includes an air-filled telescopic tube 19, and the user exercises his or her muscles through collapsing and expanding the telescopic tube 19, with the air pressure and fluid resistance providing the resistance necessary for muscular exercise. As shown, the exercise device 10 is held to the user's thighs by a pair of releasable straps 12. However, it should be understood that the user may use the multifunctional portable pneumatic exercise device 10 to exercise any suitable body part or muscle group, such as the biceps, abdominals, quadriceps, etc. The straps 12, as will be described in detail below, are adjustable and releasable, allowing the exercise device 10 to be fixed to any suitable body part.

Figure 2:
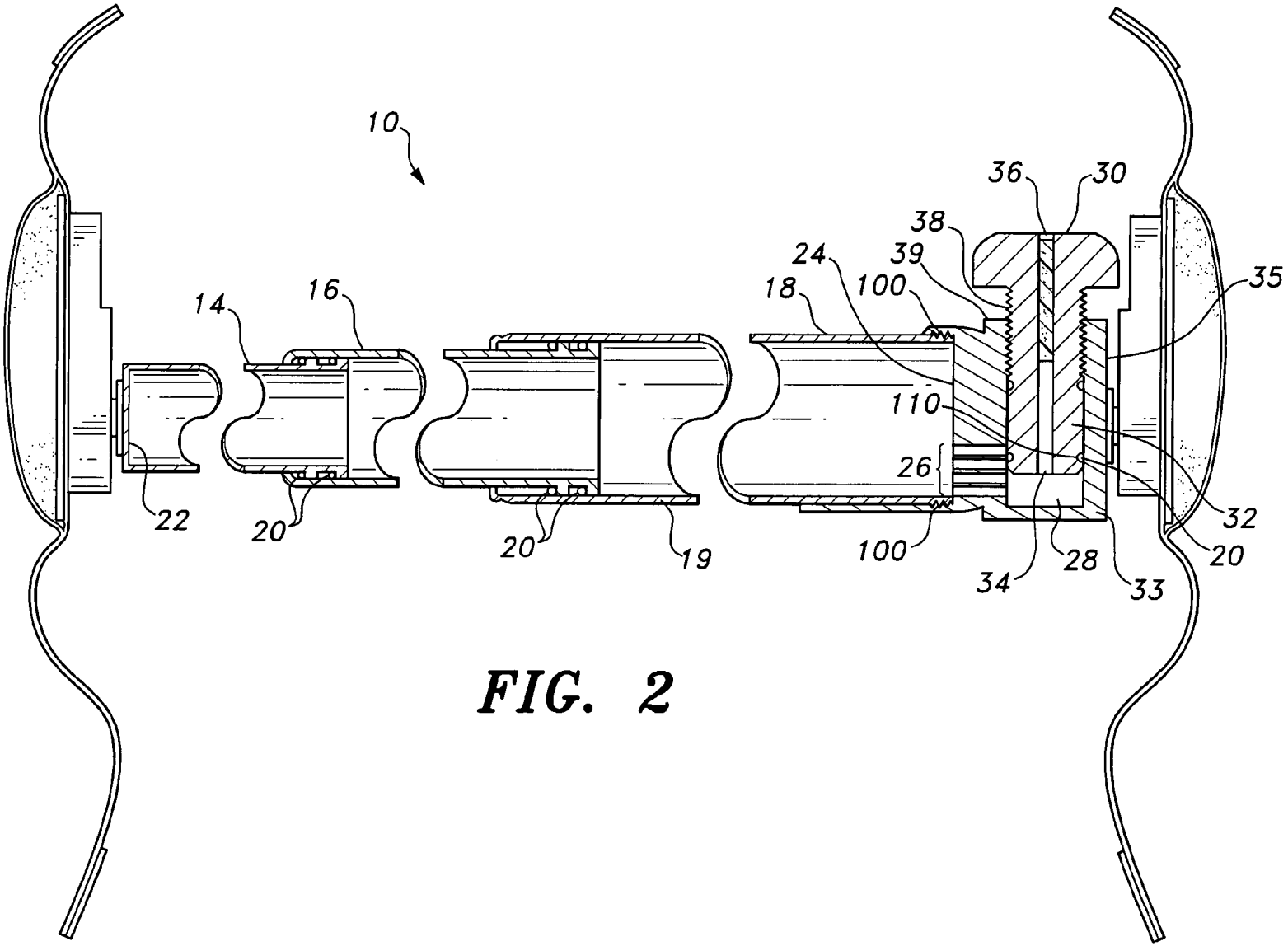
FIG. 2 is an elevation view in section of the multifunctional portable pneumatic exercise device according to the present invention.

As shown in FIG. 2, the telescopic tube 19 of the exercise device 10 includes three telescoping segments 14, 16, 18. Preferably, segments 14, 16 and 18 are cylindrical in contour. It should be understood that three segments are included in the preferred embodiment only. However, the telescopic tube may include any suitable number of telescoping segments, depending upon the needs and desires of the user. The smallest radius segment 14 includes a distal end and a proximal end. The distal end is sealed by a wall 22 and the proximal end is received within the distal end of the middle radius segment 16.

As shown, a pair of gaskets or O-rings 20 are mounted within the distal end of segment 16, forming a fluid-tight seal about segment 14. Since exercise device 10 relies on the controlled flow of air within the telescoping tube 19, it is necessary to form fluid-tight seals about the telescoping segments to eliminate uncontrolled fluid loss from within the telescoping tube 19. Similarly, the proximal end of middle radius segment 16 is received within the distal end of largest radius segment 18 and is sealed by a pair of gaskets or O-rings 20 mounted within the distal end of largest radius segment 18. It should be understood that any suitable number of gaskets or O-rings 20 may be utilized to seal the telescopic tube 19. Further, segments 14, 16 and 18 are formed from hard plastic or any other suitable material, which is lightweight, for portability of device 10, and structurally strong enough to withstand the stress and strain of exercise-related expansion and compression of the tube 19.

In FIG. 2, the proximal ends of segments 14 and 16 are shown as having raised annular flanges for engaging gaskets 20. It should be noted that this is for exemplary purposes only and that any suitable contouring may be utilized to prevent segments 14, 16 and 18 from separating from one another, and for engagement with the respective pairs of gaskets or O-rings 20.

A valve housing 33 is mounted on, and covers, the proximal end of largest radius tube 18. In FIG. 2, tube 18 is shown as being interconnected with valve housing 33 through threaded engagement at 100. However, it should be understood that tube 18 may be joined to valve housing 33 in any suitable manner. The valve housing 33 defines an open inner chamber 28 between an outer wall 35 and an inner wall 24, as shown. The interior of telescopic tube 19 is in fluid communication with chamber 28 via a plurality of openings 26 formed through inner wall 24. As best shown in FIG. 2, the plurality of openings 26 are formed through the lower portion of inner wall 24 and may have any desired size and shape. Although air is free to flow through openings 26, it should be understood that openings 26 are formed in order to create air resistance, thus providing exercise for the user as the user controls and forces air through openings 26. As described in further detail below, a user-controlled valve allows the user to control the volume and rate of air passing through openings 26. Further, although shown as having four such openings in FIG. 2, it should be understood that the number of openings 26 are dependent upon the needs and desires of the user.

A user-controlled valve, preferably in the form of a plunger or plug, is received within valve housing 33. The plunger or plug is, in the preferred embodiment, approximately one-inch long and includes a lower shaft portion 32, which selectively covers at least a portion of openings 26, allowing the user selective control over the volume of air that flows through openings 26 during expansion or contraction of tube 19. An upper shaft portion 38, which may be partially threaded, is formed above the lower shaft portion 32 and projects upwardly therefrom. Upper shaft portion 38 projects upwardly through an opening formed in an upper wall 39 of valve housing 33. Valve housing 33 is preferably formed of hard plastic or the like. Preferably, the opening formed through upper wall 39 is threaded to engage the upper shaft portion 38, allowing the user to selectively control the height of the plug within chamber 28 which, in turn, controls the amount of resistance to air flow passing through openings 26.

A grasping member 30, which may be in the form of a knob, bolt head or any other suitable gripping element, is mounted on the upper end of upper shaft portion 38, as shown. Grasping member 30 is preferably formed from hard plastic. A passage 34 is formed substantially vertically and centrally through the plunger or plug, and further through grasping member 30, allowing for the flow of air therethrough. Additionally, a damping material 36, which may be foam or any other suitable air permeable material, may be received within passage 34, in order to reduce the sound of air flowing in and out of device 10. Further, one or more gaskets or O-rings, similar to gaskets or O-rings 20, may be positioned within annular grooves 110 formed along an outer edge of lower shaft portion 32, thus preventing air from entering or escaping chamber 28 by any path other than through passage 34.

The user receives exercise through the air resistance associated with forced expulsion and suction of air out of, and into, respectively, device 10. This air resistance may be selectively controlled through control of the volume of air that enters and exits device 10. Selective vertical movement of lower shaft portion 32 within chamber 28 allows the user control over the number of openings 26 that are covered by lower shaft portion 32, which, in turn, controls the volume and rate of air which flows out of, and into, device 10.

In use, the user turns grasping member 30, which, due to threaded upper portion 38 engaging the threaded opening of upper wall 39 in a threaded manner, causes lower shaft portion 32 to selectively rise and fall within chamber 28. Threaded upper shaft portion 38 allows the user fine control over the position of lower shaft portion 32 within chamber 28, providing the user with fine and accurate control over the resistance offered by device 10. Once the user has selected the desired resistance, the user expands or compresses tube 19 in a manner similar to a pneumatic air pump utilizing a telescopic collapsing tube.

Figure 3:
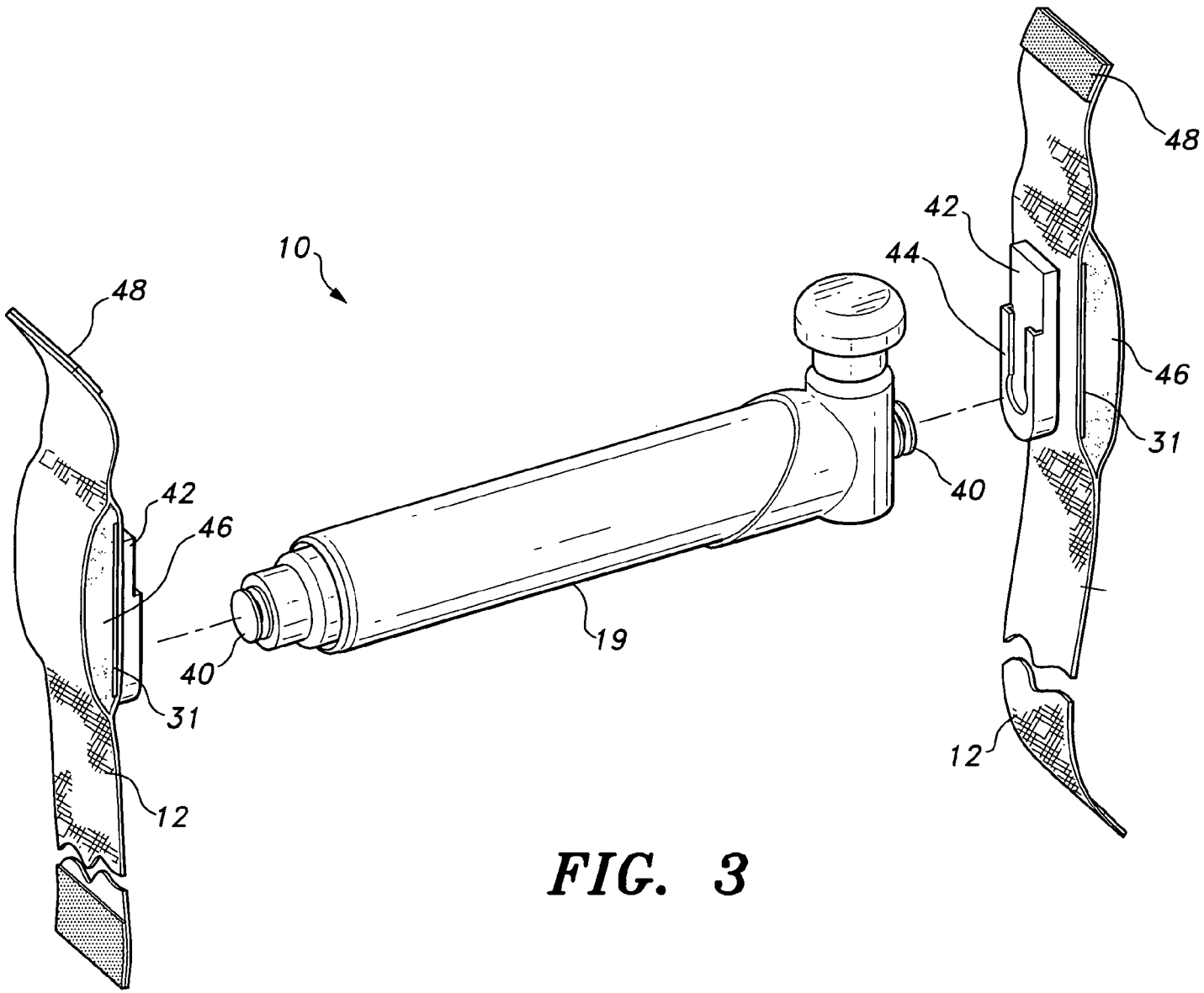
FIG. 3 is a partially exploded perspective view of the multifunctional portable pneumatic exercise device according to the present invention.

As best shown in FIG. 3, a pair of engaging members 40 are provided for releasably engaging straps 12. The distal engaging member 40 is mounted on the exterior of wall 22 (as shown in FIG. 2) and the proximal engaging member 40 is similarly mounted on the exterior of outer wall 35. Engaging members 40 may be integrally formed with walls 22, 35, respectively, or may be attached through the use of screws, nuts, or through the use of any suitable attachment means. Each strap includes a centrally mounted receiving member 42, which may be formed of hard plastic or the like, and each receiving member 42 preferably has a contoured recess 44 formed therein for releasably engaging one of the engaging members 40. It should be understood that engaging members 40 may be any suitable releasable fixtures for releasably coupling straps 12 to the main body portion of device 10. Preferably, engaging members 40 releasably lock to receiving members 42.

Straps 12 are formed from nylon or any other suitable material that is comfortable for the user and is stretchable and flexible, allowing the strap to be fixed to a multiplicity of body parts of a multiplicity of users. Each strap may include padding 46, which may be foam or the like, positioned adjacent the respective receiving member, thus reducing stress and strain on the user at the point of compressive force during use of device 10. In addition, positioned adjacent each padded member 46 is a hard plastic backing layer 31 for spreading the load force over a greater surface area, thus reducing discomfort for the user. Straps 12 may further include a buckle or a similar adjustable element, providing straps 12 with a user-adjustable length, and straps 12 further include releasable fixtures 48 at their upper and lower ends. In FIG. 3, fixtures 48 are shown as being hook and loop type fasteners. However, it should be understood that any suitable releasable fastener, such as buttons, snaps or the like may be utilized. In use, the user wraps each strap around a body part, such as the user's thighs (shown in FIG. 1), and joins the upper end of each strap to its respective lower end for comfortable securement to the body part.

Straps 12 are, in the preferred embodiment, approximately eighteen inches long. However, it should be understood that straps 12 may have any suitable length, depending upon the needs and desires of the user. Additionally, receiving members 42 may be secured to straps 12 through the use of any suitable fixtures, such as screws, bolts, melting or any other suitable securement method. Alternatively, receiving members 42 may each include a slot for receiving a respective strap therethrough. Similarly, padding 46 may be secured to straps 12 through any suitable method, such as gluing, stitching or the like.

Due to their flexible and adjustable nature, the straps 12 may be releasably secured about any suitable body part, including the thighs, ankles, wrists, forearms or any other suitable body part. Alternatively, at least one strap 12 may be secured to a support surface, such as the arm of a chair, depending upon the nature of the exercises the user wishes to perform. Straps 12 are releasable, allowing the user to exercise without straps 12 being attached to the remainder of device 10, depending upon the particular exercise the user wishes to perform, and may also be used as carrying straps during transport.

Exercise device 10 is lightweight, portable and highly versatile, in that the device 10 may be used with any suitable body part or muscle group to perform a wide variety of muscular exercises. The device 10 provides muscular resistance through the user-controlled resistance of expelling air from tube 19 during compression of the tube 19, or through the suction of air into tube 19 through the expansion of tube 19. No additional weights or other elements or devices are required to exercise the user's muscles and, further, the user may use the device for either "pushing" or "pulling" exercises, by either compressing tube 19 or expanding tube 19, respectively.

It is to be understood that the present invention is not limited to the embodiment described above, but encompasses any and all embodiments within the scope of the following claims.

I claim:

1. A multifunctional portable pneumatic exercise device, comprising:

a telescopic tube having a proximal end and a distal end;

a distal wall mounted on the distal end of the telescopic tube, the distal wall covering the distal end;

a first engaging member mounted on an exterior surface of the distal wall;

a valve housing mounted on the proximal end of the telescopic tube, the valve housing defining an internal chamber therein, the valve housing having an inner wall contacting the proximal end of the telescopic tube, a plurality of openings being formed through the inner wall so that an interior region of the telescopic tube is in fluid communication with the internal chamber, the valve housing further having an outer wall;

a second engaging member mounted on an exterior surface of the outer wall;

first and second straps, each of the straps having an engaging portion for releasably engaging a respective one of the first and second engaging members, the first and second straps being adapted for selectively and releasably securing the telescopic tube to at least one body part of a user; and a plunger axially movable within the internal chamber, the plunger having an air passage formed therethrough;

whereby the user may selectively position the plunger within the internal chamber to selectively cover a portion of the plurality of openings formed through the inner wall in order to selectively adjust fluid resistance associated with the user collapsing and expanding the telescopic tube for muscular exercise purposes.

2. The multifunctional portable pneumatic exercise device as recited in claim 1, wherein said plunger comprises:

a lower shaft portion;

an upper shaft portion having an upper end and a lower end, the lower end being joined to an upper end of the lower shaft portion; and a gripping member mounted on the upper end of the upper shaft portion, the gripping member being adapted for grasping by the user, the air passage being formed substantially centrally through the upper shaft portion, the lower shaft portion and the gripping member.

3. The multifunctional portable pneumatic exercise device as recited in claim 2, wherein the upper shaft portion is at least partially externally threaded, an opening being formed through an upper wall of said valve housing, the opening being threaded in order to mate with the upper shaft portion of said plunger.

4. The multifunctional portable pneumatic exercise device as recited in claim 2, wherein said plunger comprises:

a lower shaft portion;

an upper shaft portion having an upper end and a lower end, the lower end being joined to an upper end of the lower shaft portion; and a gripping member mounted on the upper end of the upper shaft portion, the gripping member being adapted for grasping by the user, the air passage being formed substantially centrally through the upper shaft portion, the lower shaft portion and the gripping member; and at least one gasket, the lower shaft portion of said plunger having at least one annular groove formed in an outer edge thereof, the at least one gasket being received within the at least one annular groove and annularly sealing the internal chamber of said valve housing in a fluid-tight manner.

5. The multifunctional portable pneumatic exercise device as recited in claim 1, further comprising means for sound dampening disposed within the air passage formed through said plunger.

6. The multifunctional portable pneumatic exercise device as recited in claim 5, wherein said means for sound dampening is disposed adjacent an upper end of said plunger.

7. The multifunctional portable pneumatic exercise device as recited in claim 1, further comprising first and second releasable fasteners, each of said first and second straps having an upper end and a lower end, the first and second releasable fasteners being disposed on said first and second straps, respectively, for releasably joining the upper end of one of said first and second straps to the respective lower end.

8. The multifunctional portable pneumatic exercise device as recited in claim 7, wherein the first and second releasable fasteners comprise hook and loop fasteners.

9. The multifunctional portable pneumatic exercise device as recited in claim 1, wherein the proximal end of said telescopic tube is joined to said valve housing through threaded engagement therewith.

10. The multifunctional portable pneumatic exercise device as recited in claim 1, further comprising first and second pads secured to said first and second straps, respectively, each of the first and second pads being positioned adjacent the engaging portion of the respective one of said first and second straps.

* * * * *